US007497181B2

(12) United States Patent
Viggiano et al.

(10) Patent No.: US 7,497,181 B2
(45) Date of Patent: Mar. 3, 2009

(54) SAILBOAT SAFETY SYSTEM FOR A PERSON FALLING OVERBOARD

(75) Inventors: Anthony G. Viggiano, Groton, CT (US); Martin J. LoSchiavo, Rocky Hill, CT (US)

(73) Assignee: Autotether, Inc, Chester, CT (US)

( * ) Notice: Subject to any disclaimer, the term of this patent is extended or adjusted under 35 U.S.C. 154(b) by 4 days.

(21) Appl. No.: 11/786,199

(22) Filed: Apr. 10, 2007

(65) Prior Publication Data

US 2007/0256620 A1 Nov. 8, 2007

Related U.S. Application Data

(63) Continuation-in-part of application No. 11/290,727, filed on Nov. 30, 2005, now Pat. No. 7,201,619.

(51) Int. Cl.
*B63H 9/04* (2006.01)

(52) U.S. Cl. ..... 114/102.1; 340/539.21

(58) Field of Classification Search ..... 114/102.1, 114/102.11; 340/539.21, 539.23, 573.1
See application file for complete search history.

(56) References Cited

U.S. PATENT DOCUMENTS

| | | | | |
|---|---|---|---|---|
| 4,305,143 | A | 12/1981 | Simms et al. | |
| 4,714,914 | A | 12/1987 | Boe | |
| 5,021,765 | A | 6/1991 | Morgan | |
| 5,349,329 | A | 9/1994 | Smith | |
| 5,838,227 | A | 11/1998 | Murray | |
| 5,945,912 | A | 8/1999 | Guldbrand | |
| 6,157,303 | A | 12/2000 | Bodie et al. | |
| 6,352,045 | B1 | 3/2002 | Takashima | |
| 7,083,482 | B2 * | 8/2006 | Bouge et al. | 440/1 |
| 7,119,694 | B2 | 10/2006 | Ehlers | |
| 7,201,619 | B1 * | 4/2007 | Viggiano et al. | 440/1 |
| 2004/0156327 | A1 | 8/2004 | Yankielvn | |

* cited by examiner

*Primary Examiner*—Lars A Olson
(74) *Attorney, Agent, or Firm*—C. Nessler

(57) ABSTRACT

A safety system, which stops the motion of a sail boat when a person falls off the boat, is comprised of a wireless transmitter carried by the person, a receiver-controller, an actuator, and a separable member which ordinarily holds a sail or a sail assembly in its working position. When the person falls off the boat and or the boat moves away, the diminution in wireless signal causes the actuator to separate the connecting member which holds sail in place, thus reducing the propulsive power and altering the motion of the boat. A preferred actuator stores manually input energy, to enable the use of a compact and low power solenoid type coil.

10 Claims, 9 Drawing Sheets

SAILBOAT SAFETY SYSTEM FOR A PERSON FALLING OVERBOARD

This application is a continuation in part of patent application Ser. No. 11/290,727, filed Nov. 30, 2005, now U.S. Pat. No. 7,201,619 of A. Viggiano and M. LoSchiavo.

TECHNICAL FIELD

The present invention relates to devices for stopping operation of the power source of a vehicle, in particular the engine or sail of a water craft, when the operator or other person falls off.

BACKGROUND

An obvious problem is how to protect the operator of a small boat or so-called personal water craft, when the person is alone, if the person falls overboard into the water while the boat engine is propelling the boat. The boat can continue to run on its course, leaving the operator alone in the water and in jeopardy, especially when the boat is distant from land or other boats.

A common means for protecting the operator in the prior art is as follows. A tether or lanyard runs from the operator's belt or other attachment to a plastic mechanical clip, familiarly called a "key", which slips onto the outside of a kill switch of the boat engine. The kill switch is typically located on the control or instrument panel of the boat. It has a movable spring-loaded part which has to be held in a certain position for the boat to run. As shown in FIG. 1, such key 40 which works with the spring loaded portion of the switch is distinguished from a metal turn key 34 which turns within the switch. Hereinafter, such key 40 is referred to as a latch key. When the operator falls overboard the lanyard tensions and pulls the latch key for the switch. The spring action within the kill switch breaks the electric circuit of the engine ignition system, turning off, or "killing" the engine. Taskahsima U.S. Pat. No. 6,352,045 describes a kill switch and engine control system of such type. The presumption is that the operator can swim back to stopped boat.

The disadvantage of such prevalent type of commercial system is that use of a lanyard, although simple, inhibits the normal movement of the operator and such other persons as may be on the watercraft. Other inventors have attacked the problem of providing protection in a less inconvenient way. See for example, Simms U.S. Pat. No. 4,305,143, Boe U.S. Pat. No. 4,714,914, Morgan U.S. Pat. No. 5,021,765, Guldbrand U.S. Pat. No. 5,945,912, Murray U.S. Pat. No. 5,838,227, and Ehlers U.S. Pat. No. 7,110,694. Generally, many of the prior inventions involve having a device carried by the operator, where that device communicates with components on the boat, most often by disabling a portion of the electric system, or sending some kind of message to those who remain on the boat.

While lanyard-free systems of the type mentioned above may serve the intended purpose, they have not found wide commercial use. From inquiry and observation, the reasons appear to include: that the prior art devices lack essential simplicity and low cost of the lanyard system; that they have to be either installed at the factory, or inconveniently in the field by a skilled electrician; and, that it is difficult to adapt hard-wired systems to the diversity of boat instrument panel and wiring configurations. Thus, there is a continuing need for improvement in addressing the problem. Analogous problems are presented by land vehicles, such as motorcycles, particularly those used in racing, and by snowmobiles, where is it bad for the vehicle to keep running when the operator falls off.

Problems analogous to those presented motor boats are presented by wind or sail powered craft, in that the operator or a passenger may fall overboard. Except when the vessel is under engine power as may be sometimes the case, solutions which are useful for engine powered boats, where the ignition system is disabled, are in general not suitable. A common mode of protecting sail boat occupants with respect to falling overboard is to tether the person to a portion of the boat. But such tethers are inconvenient to use and thus they are not always used. If the person on the boat is the sole occupant and falls overboard, and the boat continues on, it is a terrible problem, especially in the open sea. So, it is a problem how to slow or stop the motion of a sail boat when a person falls overboard and the boat is sailing away. Particularly, it is a problem of how to accomplish that in a way which is economic and adaptable to the great variety of designs of sail powered craft.

SUMMARY

An object of the invention is to provide an improved way of killing or reducing the functionality of the power source of a water craft, whether it be engine or sail, when the operator or another occupant falls overboard or otherwise moves away. A further object is to provide a wireless man-overboard system which is simple and economic to construct and install.

Embodiments of the invention are useful with sail boats. They may employ many of the same elements of they system which is used for engine-powered boats; such systems and elements are summarized just below. In an embodiment of the sail boat-applied invention, a sheet which holds a sail or which holds a tiller in position may be released by use of a releasable connector which is positioned between a sheet and a portion of the hull or other part of the boat, where the sheet holds the sail in working position. The connector is released under action of an electromechanical actuator, or other kind of commandable actuator. In another embodiment, a sheet is pushed out of a conventional hull cleat. When the operator falls in the water or otherwise separates from the boat the control system commands the actuator to act, as a result of the changed signal which is received at the boat, also as described in summary just below. When the connector releases one or more of the sheets or other components which held the sail in its prior power-producing position, the sail moves to a less functional position, so the motion of the boat and likely the direction of the boat are altered, which should aid the overboard person to swim back to the boat.

In accord with the invention, the engine of a motorized water craft is stopped when a person falls off the craft by means of an actuator, which acts in response to pre-determined diminution of a wireless signal from a transmitter carried by the person, causes the power source to decrease its propulsive effect. In the case of a motor boat, the actuator removes the latch key from a kill switch configured along the lines of kill switches used in the prior art with lanyards. In the case of a sail boat, the actuator disconnects a sheet from the sail of the boat or disconnects some other sheet in a way which affects the propulsive power or the direction of the boat.

In one embodiment, actuator is fastened to the latch key to thereby form a hold-release assembly which is engaged with the switch body. The actuator has a movable element, e.g., a rod, for pushing against the kill switch body, to push the assembly from the body and thus withdraw the latch key from the kill switch, thereby shutting off the craft engine. In another embodiment, the actuator pulls on a tether connected to a fixed point, to pull the latch key and actuator assembly from the kill switch. In another embodiment, an actuator is fixedly mounted near the switch and is connected to the latch key by a tether, to thereby form the hold-release assembly; and the actuator has a movable element which pulls on the tether.

In a preferred embodiment, a portable transmitter is carried by the operator or other person on the water craft and continuously sends a wireless signal to a receiver mounted on the watercraft. The latch key of a hold-release assembly holds a spring actuated plunger of the kill switch in a position which enables the engine to run. When the wireless signal diminishes below a predetermined threshold, as when the person falls overboard and separates, the receiver signals a controller that activates an electric coil of an actuator. The coil moves internal parts of the actuator, and spring loaded components which move a push or pull rod or other movable element, which results in sliding removal of the latch key from the kill switch. The engine and motion of the craft is stopped, presumably enabling the overboard person to swim back to the craft.

Further, in the preferred embodiment, after a use in which the engine is stopped, the actuator is reset for another use by manually pushing on the actuator rod, to re-store mechanical energy in the actuator, and the latch key is re-engaged with the switch. The use of the manually input energy provides the substantial force needed to remove the latch from the switch, and lessens the amount of electric power which is required, along with enabling a small actuator. In other embodiments, the actuator may use only electric energy, like a common solenoid, or may use compressed gas. The transmitter has self-contained battery power supply and the receiver, controller and actuator may be powered from batteries or the water craft electrical system. More than one transmitter carried by more than one person may be used in the invention.

With motor boats, the invention permits an operator or other person to move about freely within the confines of the motor boat, compared to a system which uses a lanyard running to the person from the switch. The invention permits the installation of a wireless signaling system on an engine powered craft which has pre-existing lanyard type kill switch, without need of a skilled tradesman or intervention into the electrical system of the craft. With sail boats, the installation is likewise adaptable to different configurations of boats and may be retrofitted without high cost. The invention is also useful with other craft and in other applications which present similar problems.

The foregoing and other objects, features and advantages of the present invention will become more apparent from the following description of preferred embodiments and accompanying drawings.

DESCRIPTION

The invention is described in terms of a boat, but will be understood to be useful to other water craft, for instance so-called personal water craft or jet-skis, for which it is appropriate to stop motion when an operator or other person falls overboard. In comprehensive form, the invention system is comprised of several essential components, the relationship of which is shown in block form in FIG. 1. Transmitter 26, having a self-contained battery power supply is carried by the operator or other person on a boat. It is in wireless radio communication with a receiver-controller 24, that has its own power supply 28, which may be that of the boat. The receiver-controller is in electromagnetic communication with the hold-release assembly (HRA) 60, as by wires or radio or light waves. The HRA 60 is physically connected to the boat kill switch, which has a built-in spring loaded "kill" mechanism. Such type of kill switch is well known commercially, for use with internal combustion engines on boats. See Taskahsima U.S. Pat. No. 6,352,045, the disclosure of which is hereby incorporated by reference. The type of kill switch used with the invention has a movable part which must be continuously held against a spring bias in order to sustain current flow in the engine ignition circuit and to keep the engine running. The kill switch 30 used in describing the best mode of the invention here has a central plunger which must be pushed down. The primarily mechanical aspects of the invention are first described. Then the functioning of the control circuit is described. The disclosure of parent patent application Ser. No. 11/290,727, filed Nov. 30, 2005, now U.S. Pat. No. 7,201,619 of A. Viggiano and M. LoSchiavo is hereby incorporated for reference, with respect to portions of the background and description which do not appear in this application.

Figure 2:
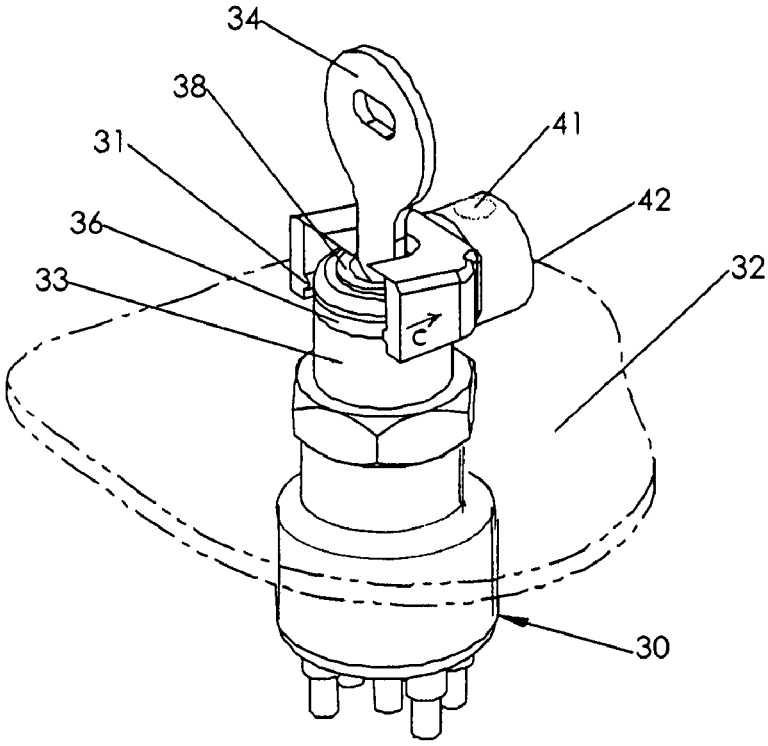
FIG. 2 is an isometric view showing a kill switch having a turn-key and an attached latch key and a portion of instrument panel in phantom.

FIG. 2 is an isometric view of a common kill switch 30 is shown as it mounts in a boat instrument panel 32, shown in phantom. A latch key 40 (also called a clip or simply a key), preferably made of thermoplastic, is engaged with switch 30 in the same manner as is familiar for lanyard-type latch keys used in the prior art. The means for connection of a lanyard to the kill switch is suggested in FIG. 2 by phantom hole 41. A feature of the invention is that it is suitable for retrofit to water craft having a variety of prior art kill switches. A further feature of the invention is a boat operator can use it in conjunction with an old-style lanyard running to his or her person, so either the lanyard or actuator causes the kill switch to stop the engine.

The internal combustion engine ignition system of a boat having kill switch 30 is turned on and off by rotation of common serrated key 34 inserted into switch 30. By design of the switch, to enable the engine to run it is also necessary that the plunger 38, the center part of the switch, be continuously depressed. To enable that, a boat operator slides latch key 40 into place around the switch, as it is shown in FIG. 2. The latch key has opposing side lips 31 within its interior cavity, which the operator engages with groove 36 of the switch body 33. In doing this, the operator necessarily depresses plunger 38; and, when in place, the top of the latch key keeps it from springing upwardly. When, afterwards, sufficient lateral force and energy is applied to the latch key, as indicated by arrow C in FIG. 2, plunger 38 springs upwardly, shutting off the boat engine. In the invention, that lateral force is provided by the actuator 50.

The upward spring force of the plunger 38 on the latch key causes friction force at the groove. By design, friction force is also created by outward expansion of the opposing sides of the latch key, in the circumferential plane of the groove. The combined frictional forces are intended to keep the latch key in place under light lateral forces, which is especially important in the lanyard type prior art system. In an embodiment of the present invention, the latch key and actuator form an assembly 60 which is supported off the switch, thus also necessitating good frictional engagement. The frictional forces are sufficient to keep the latch key engaged with the switch body in the presence of normal shaking and bumping of a boat. It may take from 5 to 8 pounds of lateral force to pull the latch key away from the switch. But as may be appreciated, that means the actuator needs to apply commensurate force to disengage the latch key. Brute force, in terms of an electric solenoid actuator may be employed, but at the penalty of weight and high electric power demand. Preferably, as described in detail below, energy is stored in the actuator by manual compression of a spring. When a person falls overboard, energizing of a small electric coil in the actuator releases the spring energy, thus providing the sufficient energy and force to pull the latch off the switch.

Figure 3:
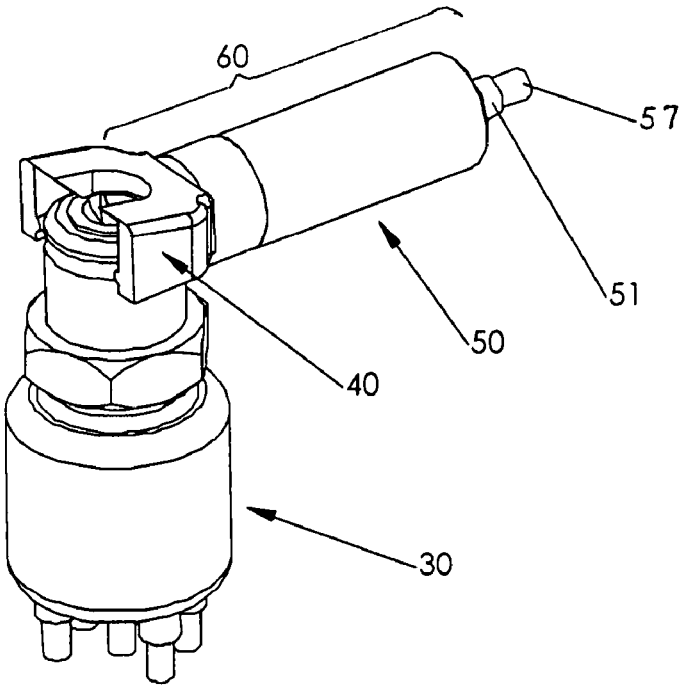
FIG. 3 is a different isometric view of the kill switch of FIG. 2, on which is mounted hold-release assembly (HRA) comprised of a latch key fastened to an actuator.
Figure 4:
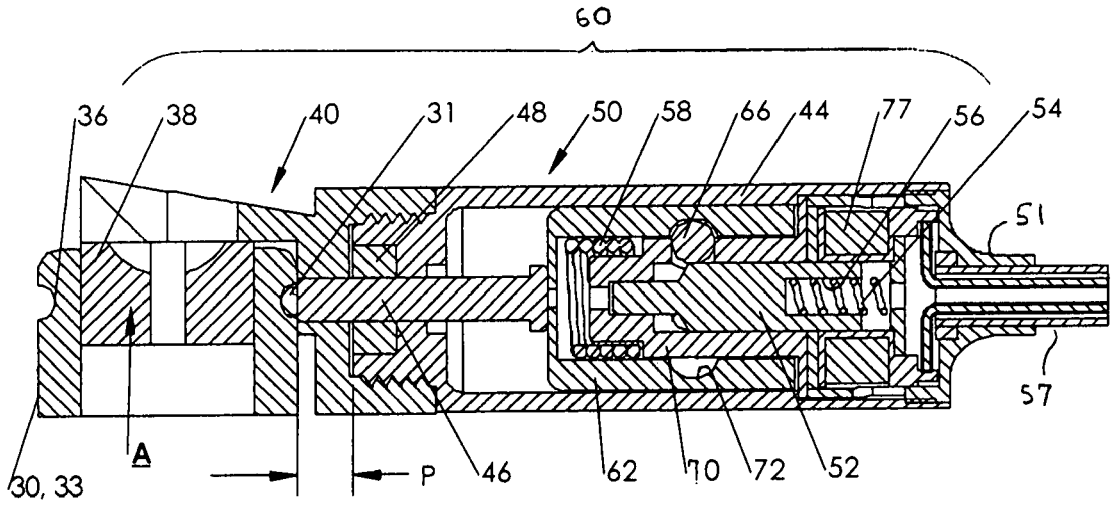
FIG. 4 is a longitudinal plane cross section of the hold-release assembly HRA of FIG. 3, and a portion of the kill switch, showing the actuator in un-energized condition.
Figure 5:
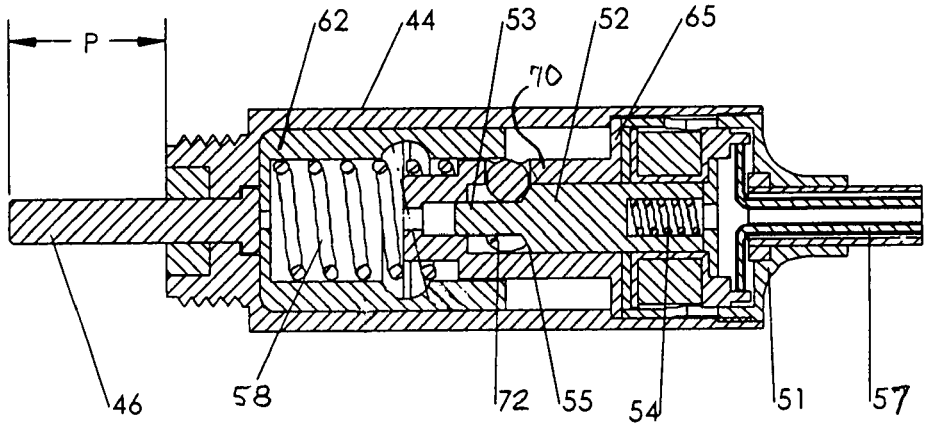
FIG. 5 is a view mostly like FIG. 4, showing the hold-release assembly HRA after the coil has been energized to extend the push rod and discharge the assembly from engagement with the switch. The view also shows and optional end cap which protects wires running to the coil.

In the embodiment of FIG. 3-5, latch key 40 is fastened to actuator 50, preferably by threads as shown, to form an integral Hold-Release Assembly (HRA) 60. When the latch key is engaged with the switch, assembly 60 has holds the switch plunger depressed in place. When the signal received at the receiver at the boat diminishes below a pre-determined threshold, the latch key is pulled off the switch by actuator. A push rod of the actuator pushes against the side of the switch body, and the actuator is forced away from the switch, laterally pulling the attached latch key off the switch. If needed, the HRA can be attached to the instrument panel by a flexible cord to prevent it from falling away as it is disengaged from the switch. The latch key 40 can have different shapes from that illustrated here, as taught by the prior art. For example, some prior art kill switches have a plunger which must be held in raised position. The invention may also be applied to a kill switch which has a rotary, rather than up and down, "kill element" action; and to a kill switch which acts as does a toggle switch.

FIG. 4 is a longitudinal cross section of HRA assembly 60, showing in more detail how it engages kill switch 30. Latch key 40 is threaded onto outer housing 44 which is preferably made of thermoplastic. Other means of fastening, e.g., set screws, may be used. FIG. 4 shows the position of HRA components when sufficient radio signal from the transmitter is being received, i.e., when things are normal and the operator is in the boat. The actuator is said to be in its spring energized condition. In that condition, HRA 60 cantilevers in space from its mounting on the kill switch by means of the latch key engagement; and, plunger 38 is depressed. Arrow A shows the spring bias of the plunger and capability for vertical motion.

FIG. 5 is like FIG. 4 but shows the actuator 50 in its de-energized condition. This is the condition when the signal to the receiver has diminished or ceased, e.g., when someone has fallen overboard. The FIG. 4 view omits switch 30 and adds a desirable end cap 51, which screws onto the outside of housing 44 and protects wires, not shown, which run to the electromagnetic coil 77 at the right end of the actuator. Actuator 50 is connected by wires 57 or other electromagnetic power transmitting means to the receiver-controller.

Referring to both FIG. 4 and FIG. 5, a movable element, namely push rod 46, protrudes from a seal, preferably a lip seal 48, at the end of the actuator which attaches to the latch key. When HRA 60 is mounted on a switch, push rod 46 contacts or is in close proximity to the side of switch. See FIG. 4. When, as a consequence of diminution of radio signal strength received by the receiver-controller assembly 24, the coil 77 becomes energized, thus causing release of stored energy in main spring 58 which makes the push rod 46 move outwardly so that the plunger extension P increases. The extension P is sufficient to cause the latch key to withdraw from engagement with groove 36 of the switch. The whole HRA 60 moves to the right, and will fall away by momentum and gravity from vicinity of the switch. As desired, some restraint like a bracket or line may be used to keep it nearby. When the latch key is removed from the switch, switch plunger 38 moves upwardly, thereby cutting the engine ignition system.

To reinstall HRA 60 on the switch, push rod 46 is manually pressed inwardly to the position shown in FIG. 4. As described below, when that is done and HRA has been de-energized, the push rod stays pressed-in. The latchkey lips 31 are slid back into the groove 36 of switch 30, while the switch center part 38 is manually depressed, as described above. The actuator provides sufficient force to pull the latch key from the switch, of the order of 5 to 8 pounds force. The actuator has unique construction to provide sufficient energy and force, but at the same time be compact and light, and economic to manufacture. This construction will now be described. Reference is again made to FIGS. 4 and 5.

In the FIG. 4 there is no power to electromagnetic coil 77 and the HRA is mounted on the kill switch. Shuttle 52 lies within the coil 77. It is made of electroplated magnetic steel. Shuttle spring 54 is of the compressive type. It is positioned within cavity 56 at the right end of shuttle 52. Coaxial sleeves 62, 70 circumscribe the shuttle 52. Fixed inner sleeve 70 has three circumferentially-spaced apart radial holes 72, within which are loosely held three latch key balls 66. Shuttle 52 moves lengthwise within the bore of inner sleeve 70. Inner sleeve 70 moves lengthwise within the bore of outer sleeve 62. In use, balls 66 alternately move radially out and in, as described below, to thereby alternately lock and release the sleeves 62, 70 from engagement with each other.

Inner sleeve 70 is made of non-magnetic material, such as Delrin thermoplastic or stainless steel. It is fixed in position by engagement of flange 65 with the bore of Nylon housing 44. Outer sleeve 62 is made of 300 series stainless steel. When outer sleeve 62 moves lengthwise (to the left in the FIG. 4), the closed end of sleeve 62 pushes on stainless steel push rod 46, increasing its extension from the actuator housing. Conversely, when push rod 46 is pressed inwardly, it moves sleeve 62 to the right toward its home position where it stays, provided the actuator and coil are de-energized. Manually pushing the push rod in compresses main spring 58, which is captured between the outer and inner sleeves so it urges them to separate. The drawings show various axial holes along the central axis which allow escape or entry of air, so captured air or vacuum does not impede the linear motions of the parts.

In operation of the actuator, coil 77 is energized as a result of a change in radio signal from the transmitter worn by a person who has fallen overboard or who has otherwise left vicinity of the receiver controller. When the coil is energized, shuttle 52 is magnetically moved into the coil 77 (to the right in the FIG. 4), thus compressing shuttle spring 54 and storing energy therein. The left end of shuttle 52 has a tapered shoulder 55 running to a smaller diameter end 53. The spring force on sleeve 62 is applied to the balls 66, urging them radially inwardly. Thus, when the smaller diameter portion of shuttle 52 moves and presents itself at the transverse plane location of the balls, they do move inwardly. That frees outer sleeve 62 from engagement with inner sleeve 70. That enables outer sleeve 62 to move away from the coil (to the left in FIG. 4). The motion of sleeve 70 causes push rod 46 to extend, and thus HRA 60 is ejected from the kill switch. The disposition of the internal parts of the actuator after these actions have taken place is shown in FIG. 5.

After the push rod has extended, electric power to the coil will be terminated by a control circuit timer in the controller. However, when the power to the coil is terminated, shuttle 52 does not move back to its home position, since it is restrained by balls 66 which are in contact with its shoulder 55. Nonetheless, the operator of the boat will now reset the actuator for another use. The operator manually depresses push rod 46. That compresses main spring 58 while moving outer sleeve 62 to the right, toward the coil. When the motion of sleeve 62 is sufficient, balls 66 will be thrust outwardly due to the force of shuttle spring 54, transmitted at shoulder 55 of the shuttle 52. Then, shuttle 52 moves in the opposite direction, with release of the stored energy in shuttle spring 54. The changed position of the shuttle prevents radially inward motion of the balls, and the outer sleeve 62 is again locked into its home position, characteristic of the de-energized state of the device. In a variation not shown, the push rod may rotate a cam which is in contact with the side of the switch body, for more amplification of mechanical force. Within the scope of the claimed invention, the term spring as used herein is intended to comprehend devices other than those made of spring-steel for storing energy, such as elastomers, gas compression cylinders (gas struts), and spring substitutes, such as linear actuators.

In the generality of the actuator construction and use, manual or mechanical energy of the operator is stored in the device, e.g., in the main spring by depressing the push rod to set the device. Release of that stored mechanical energy is prevented by an internal mechanical latch keying means, e.g., the balls. Electromechanical means, e.g., the coil and movement of the shuttle when the coil is energized (which movement is often referred to as "solenoid action"), releases the actuator internal locking mechanism, to enable release of the stored energy, which extends the push rod and ejects the HRA from the kill switch.

In some commercial kill switches, the movable element is spring biased to cause the plunger to move inwardly, into the switch body, rather than outwardly, when the latch key is removed, to stop an engine. The invention will be useful with such devices by use of a suitable latch key, similar to that used when such devices are operated by means of a lanyard.

Figure 6:
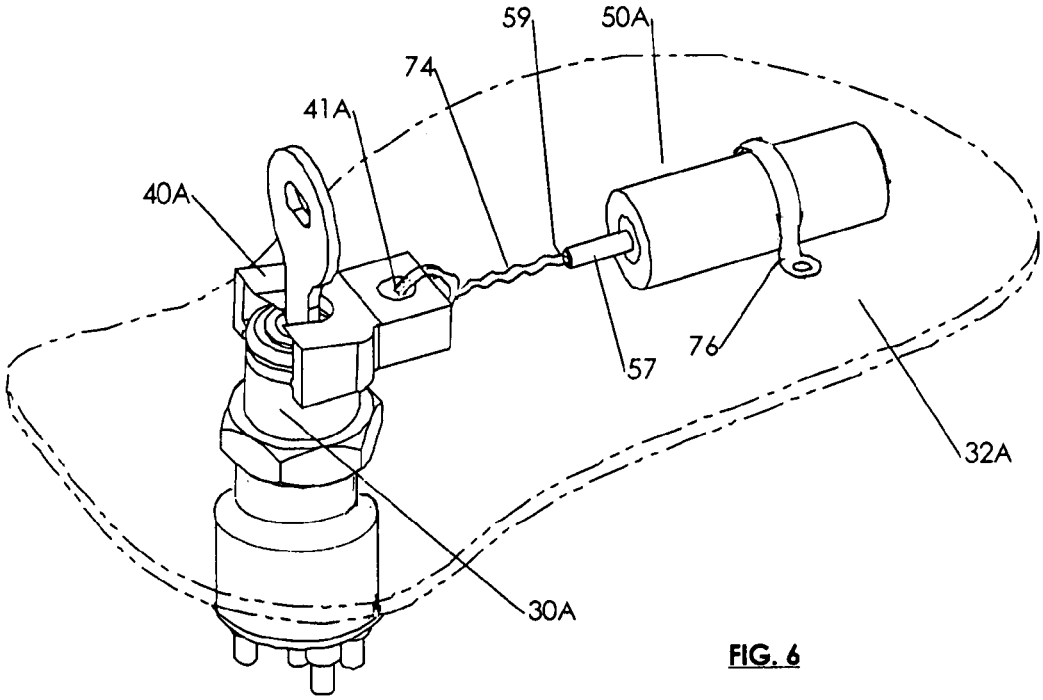
FIG. 6 is an isometric view of a hold-release assembly HRA wherein the spaced apart actuator is connected to the latch key by a tether.
Figure 7:
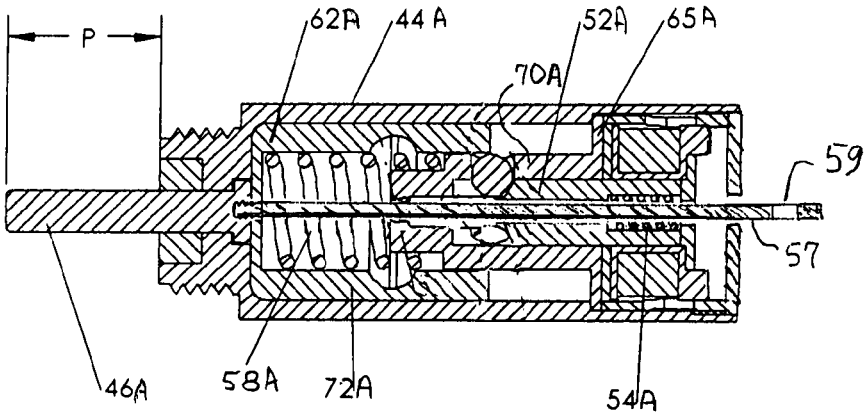
FIG. 7 shows an actuator having a push rod rather than a pull rod.

FIGS. 6 and 7 show an alternate embodiment of the invention in which the rod of the actuator pulls rather than pushes. Parts having numbers with suffixes in these and other Figures correspond with those previously described. The latch key 40A is mounted on the switch 30A as previously described. Actuator 50A is fastened by clamp 76 to the instrument panel or another surface of the boat in vicinity of the kill switch. Tether 74 runs between the pull rod 57 of actuator 50A and latch key 40A. When commanded to act, the actuator pulls on the tether, pulling the latch from the kill switch, to stop the engine FIG. 7 shows one way in which the actuator 50 of FIGS. 4 and 5 can be modified to pull rather than push. FIG. 7 is an adaptation of FIG. 5, and shows the actuator when rod 57 has been pulled into the actuator. The power lines running to the coil are omitted. Pull rod 57 screws into the base of shuttle plunger 46A; and it extends through clearance bores in the various components including elements 70A and 52A. Hole 59 enables connection of tether 74 to rod 57. For this and other embodiments, variations in the mechanical construction of the actuator may be employed to achieve the same functional result. Commercially available solenoid type actuators may be utilized, although that could involve more complexity or larger size.

Figure 8:
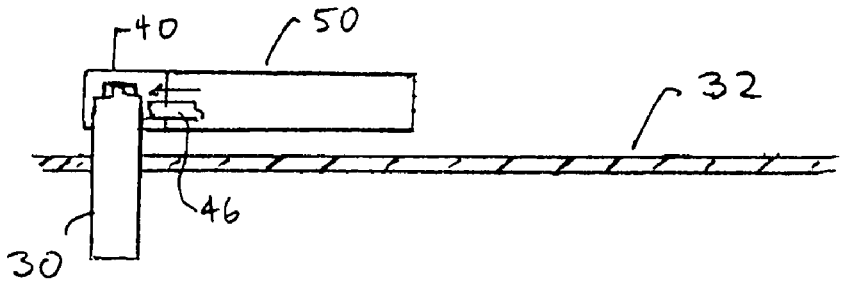
FIG. 8 is a semi-schematic view of essential parts of the invention system, showing a latch key fastened to the actuator, where the assembly is mounted on the switch, in accord with FIG. 3.
Figure 9:
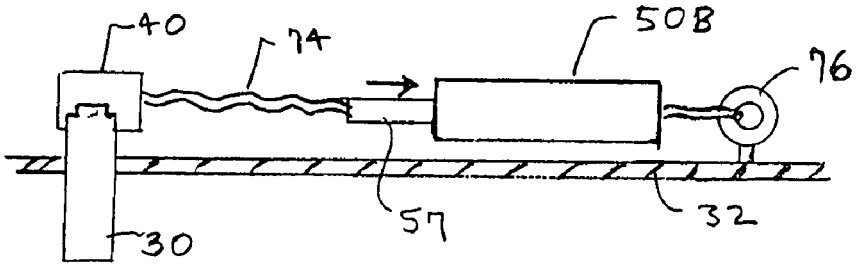
FIG. 9 is similar to FIG. 8, showing an actuator which is tether connected both to the craft and to the latch key which is on the kill switch.
Figure 10:
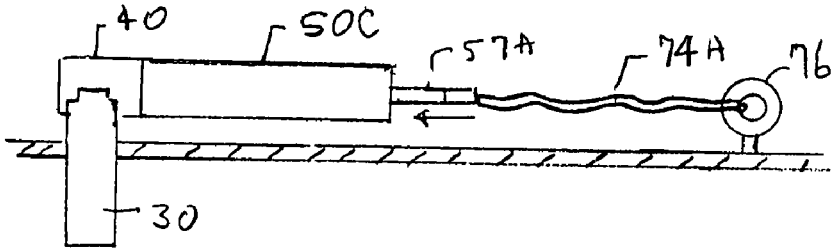
FIG. 10 is similar to FIG. 8, showing a latch key fastened to the actuator which is tether connected to the craft.

FIGS. 8, 9 and 10 semi-schematically show different embodiments of the invention. The motion of the rod of the actuator is indicated by an arrow. FIG. 8 corresponds with the invention described for FIGS. 3, 4 and 5. FIG. 9 corresponds with FIGS. 6 and 7, with the variation that an end of the actuator is connected to a second tether which runs from a ring attachment point 76, rather than having the actuator mounted on the instrument panel 32. FIG. 10 shows another variation, in which the actuator has a rod 57A which, when energized, retracts and pulls on tether 74A that runs to ring 76. The resultant tension force causes the latch key and actuator assembly (40 and 50C) to be pulled from the kill switch.

While an actuator having a rod which moves linearly has been described, other forms of actuators can be used, as are known in the ordinary skill, for obtaining linear motion. For example, the movable element of the actuator can be a reel which draws a tether around it, in winch-like fashion. In another example, the movable element may be a rotatable cam, which pushes the actuator and HRA from engagement with the kill switch.

Figure 1:
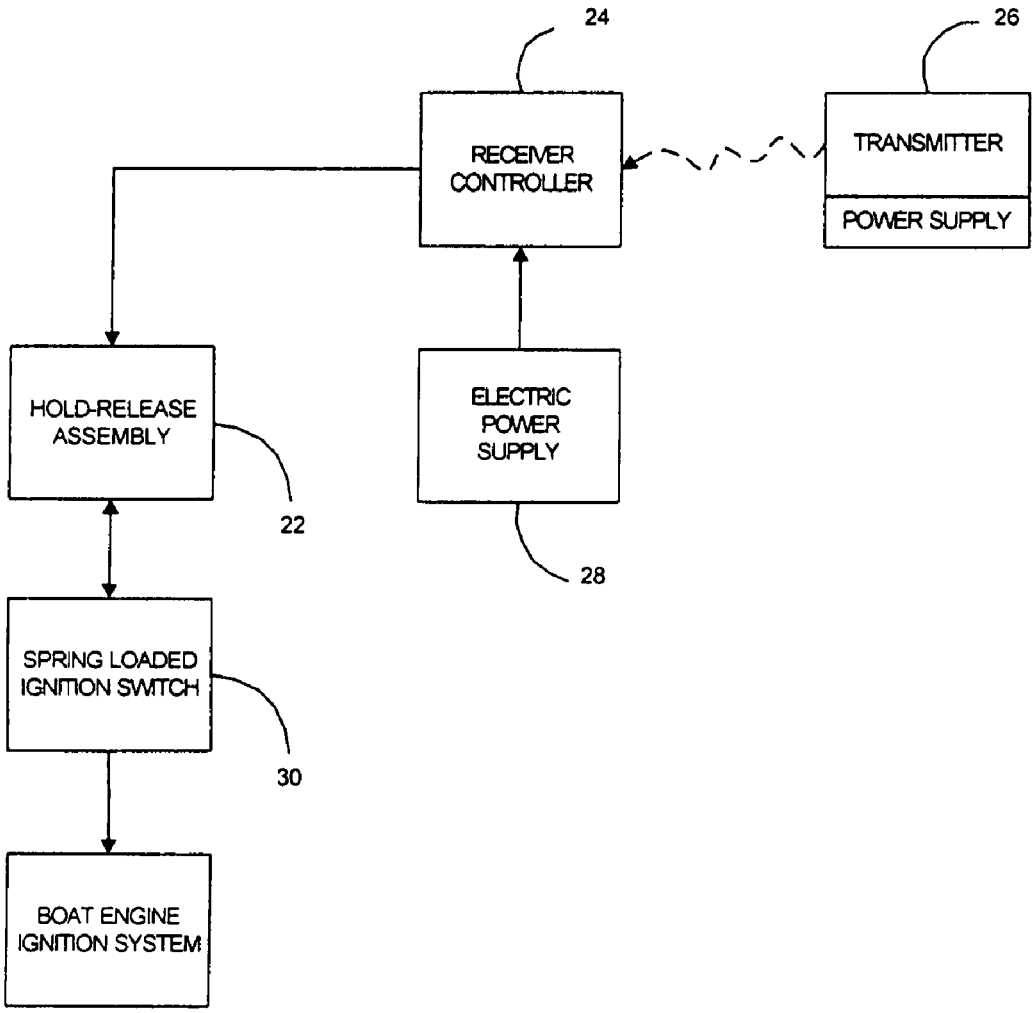
FIG. 1 is a diagram showing the major components an embodiment of the invention system.
Figure 11:
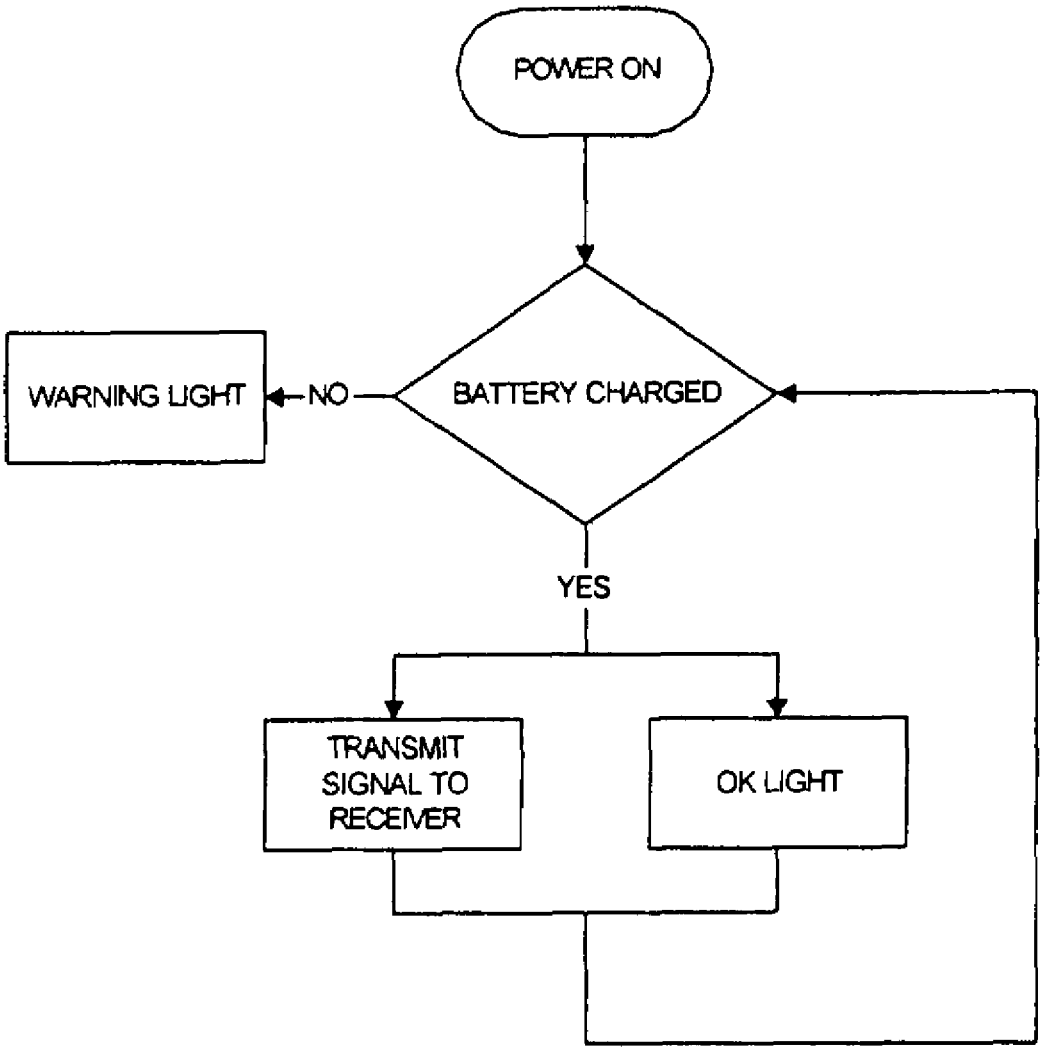
FIG. 11 is a function flow diagram for the receiver-controller and actuator which receives a signal from the transmitter
Figure 12:
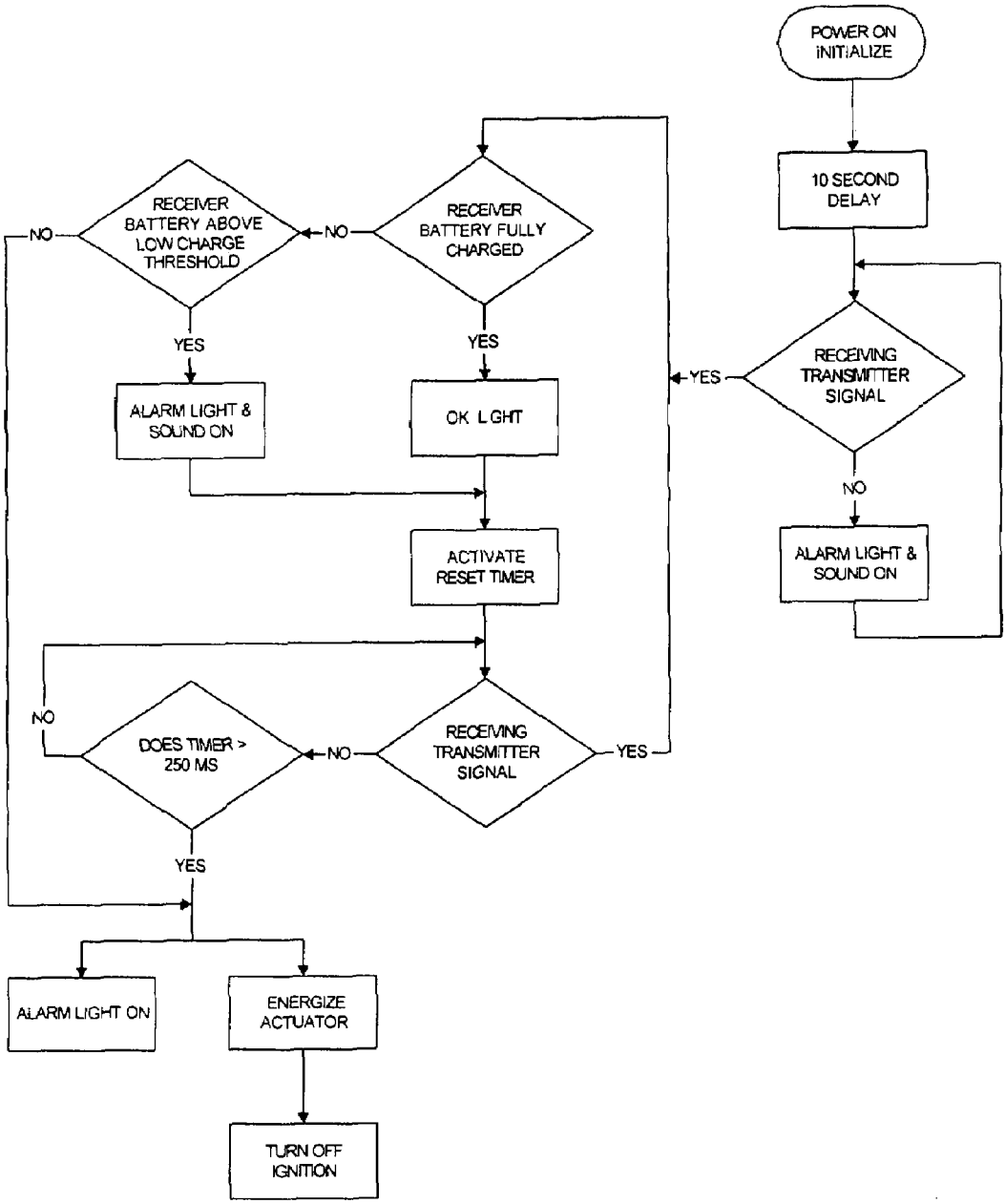
FIG. 12 is a function flow diagram for a transmitter which sends a signal to the receiver.
Figure 13:
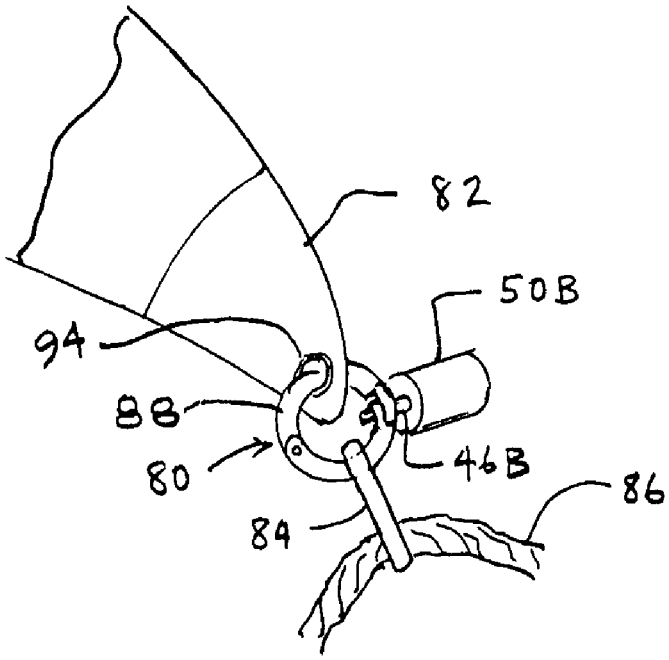
FIG. 13 shows how the invention can be used to release the sheet of a sail of a sailboat.
Figure 14:
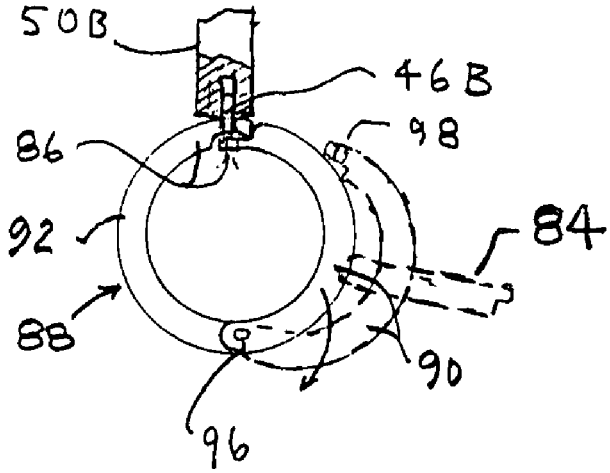
FIG. 14 is a detail of the split ring used in the apparatus of FIG. 13.

As mentioned, FIG. 1 shows the overall interconnectedness of the elements of the system of the present invention. FIG. 12 is a function flow chart for the receiver-controller 24 and FIG. 11 is a chart for the transmitter. They are discussed below. The radio transmitter 24, worn by the operator or other boat occupant, and radio receiver-controller 26, mounted on the boat, are preferably comprised of commercially available elements. For example, the transmitter may send signals at 300-400 megahertz. They may be constructed along the lines indicated in patents of the Background.

Generally, the controller commands the actuator to pull the latch key from the switch when the signal from the transmitter received by the receiver diminishes beneath a certain predetermined threshold. That diminution in signal can be due to increased physical separation of the operator from the receiver, or due to immersion in water of the transmitter. The threshold can be fixed, or settable according to the dimensions of the boat or other user-factors. In alternate embodiments, other electromagnetic signaling than those which use radio frequency wavelength may be employed. For instance, ultrasonic or optical sources and sensors may be used.

FIG. 12 shows the functioning of receiver-controller 24, hereafter simply called "receiver." The receiver has conventional components for converting input radio signals to output to the actuator. The unit and any self-contained battery power supply are preferably within a water-tight box, upon the surface of which are mounted switches, visual alarms and other displays which may be desired.

In a first part of its function, the receiver checks to see if a signal from the transmitter is present. If it is not, an alarm is given and the device will not function. If the transmitter signal is present, the system checks the condition of the receiver power supply, i.e., the battery charge or voltage. If it is wholly inadequate, an alarm is given, and the actuator is commanded to pull the latch key from the switch. If the power supply condition is marginal, an alarm is given, but the unit will function. The system persistently checks to see if the requisite transmitter signal is present. If a sufficient signal is not received, there is appropriate re-checking, with use of a timing circuit, to accommodate a momentary inconsequential lapse of signal, or other electrical fluctuation. When a continuing absence of sufficient signal is verified, the receiver causes the actuator coil to be energized by applying power to it. The actuator thus mechanically removes the latch key from the switch, as previously described. The engine ignition system is thus killed. Power flow to the coil and or the receiver may then be terminated by functions which are not shown in the chart. To reset and reinstall the mechanism on the kill switch, the power flow to the coil is ceased, as necessary. The operator mechanically resets the HRA by pushing on its push rod, as described above, and remounts the latch key on the switch. Then the power to the receiver is restored and the unit is ready to function again.

FIG. 11 shows the function of the transmitter 26. If the power supply is insufficient, a warning light is displayed. If power is sufficient, an OK light is displayed and a radio signal is continuously and omni-directionally transmitted.

The technology for sending signals from portable transmitters to a receiver, and detecting and acting on them, is well known in the electric control system arts. We have only described a simple radio transmit-receive system. More sophisticated techniques known in the art may be employed, particularly for reliability or for difficult operating environments.

And other electromagnetic means of sensing the presence of absence of proximity of a person or thing to the controller and craft may be used. While an active continuously-transmitting device is preferably carried by the operator, non-continuously signalling and interrogation type systems may be used. For instance, RFID and ultrasound technology may be used. Radio signals typically diminish when the transmitter becomes submerged, thus enabling quick signaling to the receiver to stop the engine. Radio signals are preferred in practice of the invention, but other wireless communication means, such as optical devices may be substituted. In an alternate less preferable approach, a device which sends a signal when coming into contact with water may be used, when in the normal condition, there is no signal being transmitted.

The system has been described in terms of a single transmitter. Multiple transmitters on multiple people may be used; and, the receiver can be configured to receive their different frequency signals, and to act on a failure to receive any one signal.

Other actuators may be employed in place of the electromechanical HRA which has been described, to withdraw the latch key from the switch. For instance, the actuator may be miniature pneumatic piston cylinder with an associated gas supply such as a compressed carbon dioxide miniature tank. When the requisite transmitter signal is not received, the receiver-controller activates a valve, causing flow of compressed gas into the cylinder, to move a push rod or pull rod, and remove the latch key, in the way described. Such a system is less preferred because of the possibility of gradual gas leakage over an extended period of time.

The invention can be applied to kill switch designs other than that illustrated, by modification within the ordinary skill of artisans. For example, some kill switches comprise a central button which retracts into the body of the switch, when the latch key is withdrawn from the grooves of the button. For example, some switches have a tang which is engaged by a plastic loop; and when the loop is pulled away from the switch, the engine is killed. For instance, a non-magnetic shaft attached to the closed end of outer sleeve 62 could run through a lengthwise hole in shuttle 52, so it extends from the rear end of housing 44. While the actuator is preferably intimately physically attached to the latch key as has been described, in alternate embodiments the actuator may be spaced apart from the latch key and switch, to be connected by a lanyard.

While the invention enables continued manufacture and use of boats with the familiar lanyard type kill switches, the invention may carried out with new kill switches, especially configured for use with a wirelessly commanded actuator. Similarly, the invention may be applied to craft having diesel engines which do not require used of an ignition system, by actuating the means by which the engine is ordinarily stopped, such as by stopping fuel flow to the engine through an electrically controlled valve.

While the invention has been described in terms of water craft, it may be applied in similar fashion to land craft. For instance, it may be used with motorcycles, snowmobiles and the like, which are powered by internal combustion engines.

The invention offers advantages previously sought by other inventors, where separation of a transmitter and receiver causes the killing of the engine. Moreover, the invention enables a boat which is in the field, or in a factory, to be fitted with a non-lanyard safety system without intervention into the electric system or use of any electrical craft skills.

FIG. 13-16 show how the invention may be applied with good effect to water craft for which the sail is the power source, i.e., to sail boats. In the embodiment illustrated by FIGS. 13 and 14, a sheet (rope, or line) 86 normally holds the sail in a position, called the working position, where the sail powers and propels the boat through the water. When reference is made to a sail in this embodiment of invention and the claims related thereto, it should be taken also to include reference to a sail assembly or a boat component which is directly connected to the sail and its propulsive-power position on the boat. For instance, the reference includes one to a boom to which the bottom portion of a main sail on a single masted boat is commonly connected.

In carrying out the invention, the sail 82 is connected to the sheet by hold release assembly (HRA) 80. Assembly 80 is comprised of an actuator 50B and a connector which comprises a separable mechanical member, in particular, split ring 88 in the FIG. 13 embodiment. Each of the two hinged semicircular halves 90, 92 of the split ring 88 are connected at one end by hinge pin 96 and the opposing ends 86 are ship-lapped for mating to each other. The ship-lapped ends have aligned holes through which pull rod 46B of actuator 50B passes. The actuator is fixed to ring half 92 by structure which is not shown, within the ordinary skill. The actuator is connected by wires or wireless means to the controller, in accord with the prior description.

When installed for use, sail sheet 86 runs through one-piece ring 84 which is attached to the sail 82 by means of split ring 88. The sheet is attached to the hull of the vessel or some other element which is fixed relative to the hull; said attachment is not pictured in the Figure. Actuator 50B is constructed similarly to actuator 50A of FIGS. 6 and 7. In operation, as a result of the change in the signal at the receiver, sent from the transmitter, the actuator is commanded to move, and pull rod 46B is pulled from the holes of the ship-lapped ends of the split ring. The force between the sail and sheet pulls the split ring apart, as illustrated by the phantom of ring half 90 in FIG. 14, thus releasing the sail. Thus, the working position connection is released.

Figure 15:
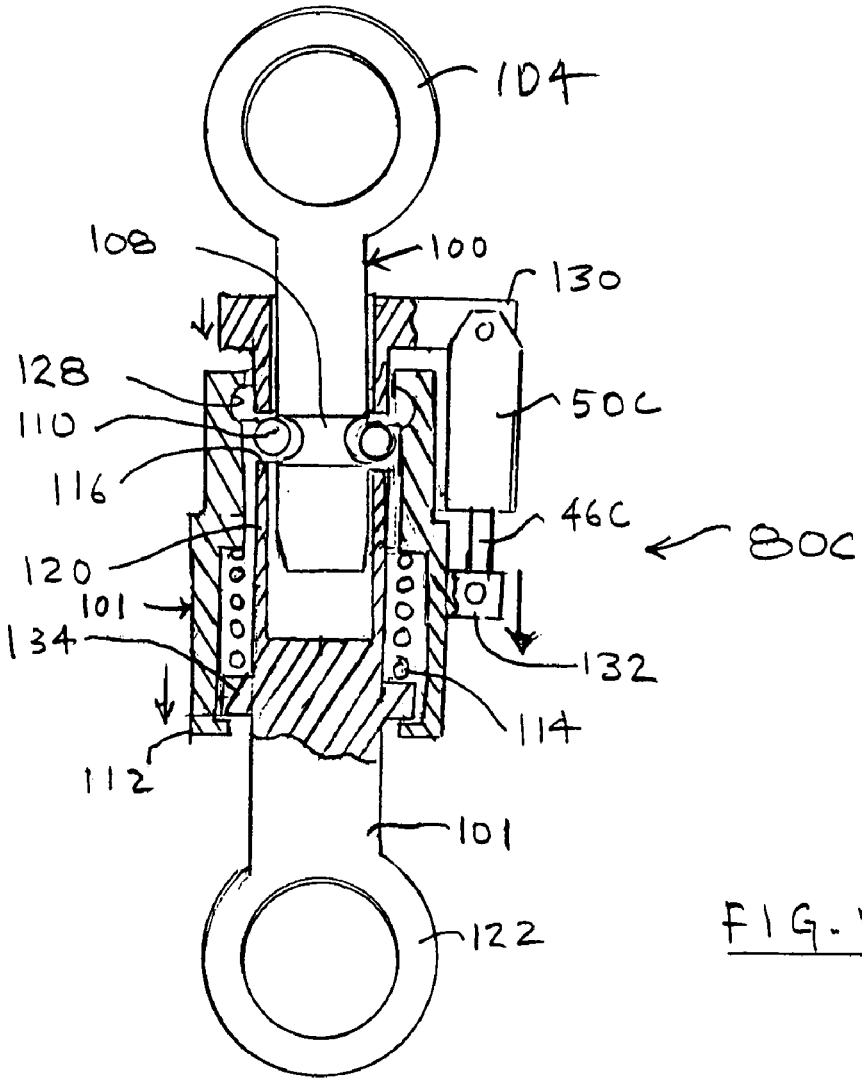
FIG. 15 is a partial cutaway vertical cross section of an alternative separable member for connecting a sheet to a sail.

FIG. 15 is a vertical plane partial cross section view of another embodiment of hold release assembly (HRA), namely HRA 80C. The sail and sheet, not shown, are connected by engagement respectively with opposing end rings 104, 122. Ring 104 is at the end of member 100, which has an overall shape like a so-called eye bolt. Ring 122 is at the end of member 101, which is part of female assembly 102 that receives member 100. As will be seen, the HRA is separable, by release of member 100 from its captured position. Member 100 is normally kept in place by several circumferentially distributed balls 110 which are movably captured within holes 116 of the hollow cylinder upper end 120 of part 101. The balls engage circumferential groove 108 of the shank of part 100. Sleeve 112 is biased upwardly by spring 114 which rests on the flange 134 of part 101. Circumferential groove 128 runs around the bore of the upper end of sleeve 112. It is adapted to receive radially moving balls, when the groove is moved to the elevation of the balls. Actuator 50C is connected between bracket 130 on the upper end 120 of part 101, and bracket 132 which is integral with sleeve 112. When the actuator is appropriately commanded to extend the plunger 46C, parts move as indicated by the arrows in the picture. In particular, sleeve 112 of assembly 102 moves downwardly against the spring force, bringing circumferential groove 128 to the elevation of the balls, so they can then move radially outwardly—which they will do when there is a pulling force on ring 104. When the balls move radially outwardly part 100 is released, thereby disconnecting the sheet from the sail and reducing or stopping the motion of the boat.

Figure 16:
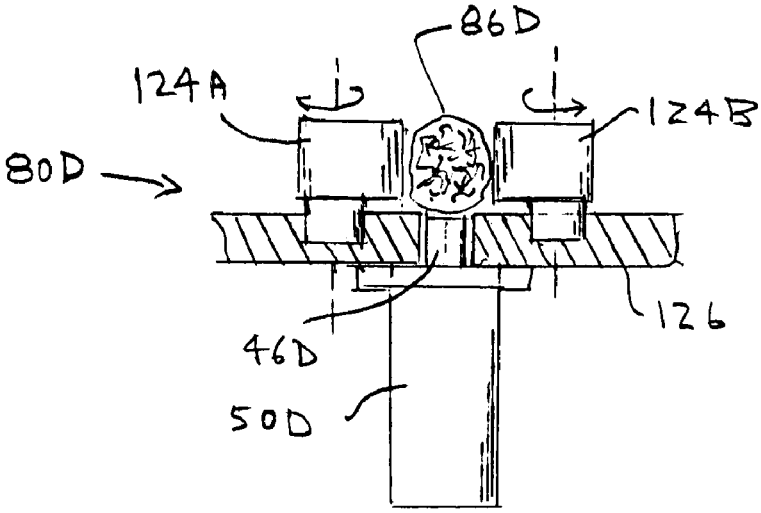
FIG. 16 is a partial cutaway vertical cross section through a section of boat hull having a cam type cleat with a captured sheet, along with an actuator for vertically ejecting the sheet from the cleat.

FIG. 16 is a vertical elevation view through a portion of boat hull, namely deck 126, showing another embodiment of HRA, namely HRA 80D. Sheet 86D is shown as it runs through a conventional cleat assembly comprised of spring biased rotatable eccentric cams 124A, 124B, as indicated by the arrows. The cleat is affixed to the deck; it is shown in simplified fashion. Ordinarily the cams are made of hard rubber or other material and they have serrations (which would be vertical in the picture) so that they may grip the sheet and resist motion of it parallel to the deck (perpendicular to the plane of the drawing). In the invention, the actuator 50D has a plunger 46D which when the actuator is commanded to act, thrusts upwardly, to push the sheet vertically from between the cams, thus releasing it and the attached sheet or other thing from its secured connection to the deck of the boat. Alternately, the actuator may be mounted parallel to the deck and transverse to the line of the sheet. The actuator may have a wedge at the end of the plunger, the tip of which wedge barely underlies the sheet where it passes through the cam. Thus, when the plunger moves and the thicker portion of the wedge passes under the sheet, the sheet is lifted.

Actuators other than linearly acting actuators, or the preferred actuator described above, may be used in this aspect of the invention. Multiple HRAs may be used on any one boat, so that more than one sheet is released when a person falls overboard. Other releasable mechanical devices as are known commercially and may be constructed within the ordinary skill may be used in substitution of the separable connectors and actuators which have been just described. A HRA may be used to release other lines than those securing sails. For instance, a HRA may be used to release a line securing a tiller. When the sail boat has an engine, the previously described engine-related embodiment may be used. When the sail boat does not have an engine and a related electric system, batteries can be used to power the receiver, control system, HRA, etc. If the sail boat has an electrically powered autopilot which admits of control by means of a rotatable key or kill switch or other analogous device, then the embodiment of the invention which is used for motor boats may be employed.

Although this invention has been shown and described with respect to one or more preferred embodiments, and by examples, those should not be considered as limiting the claims, since it will be understood by those skilled in this art that various changes in form and detail thereof may be made without departing from the spirit and scope of the claimed invention.

We claim:

1. Apparatus for use on a sail-powered vessel adapted to carry at least one person, which vessel is movable on the surface of water as a result of propulsive power of a sail, the vessel having a sail held in a working position by at least one sheet, comprising:

means for receiving a wireless signal, adapted for placement on the vessel;

means for wirelessly sending a signal to said means for receiving;

means for disengaging a sheet which holds a sail in said working position, responsive to a predetermined change in the strength of said wireless signal which is received at said means for receiving, to thereby reduce the propulsive power of said sail.

2. The apparatus of claim 1 wherein the means for disengaging comprises a hold and release assembly comprised of:

a mechanical member, for releasably connecting the sail and sheet so that the sail may power the boat; and, an actuator, for acting on the mechanical member to cause it to release the connection between the sail and sheet;

wherein, in response to said signal strength change, the means for receiving causes the actuator to act on the mechanical member to thereby release the connection between the sail and sheet and to thereby decrease the propulsive power of the sail on the vessel.

3. The apparatus of claim 1 wherein the means for disengaging comprises:

(a) a hold and release assembly comprised of (i) a mechanical member for releasably holding the sail and sheet in connected position relative to each other so that the sail is in said working position for powering the boat; and, (ii) an actuator, having an element for acting on the mechanical member to cause it to release the sail and sheet from said connected position;

(b) a controller for causing said element of the actuator to move in response to a signal from the means for receiving which is generated responsive to a change in strength in said wireless signal; wherein the movement of said element causes said mechanical member to release said sheet from said connected position;

wherein, in response to said signal strength change at said means for receiving, the actuator causes the mechanical member to release the connection between the sail and sheet, to thereby alter said working position of the sail and decrease the propulsive power of the sail on the vessel.

4. The apparatus of claim 1 wherein the means for wirelessly sending a signal is a portable transmitter, for carrying by a person; where said means for disengaging comprises (a) an actuator; and, (b) a mechanical member attached to actuator, for engaging and disengaging a sheet; further comprising: at least one second transmitter, wherein the first transmitter sends a first characteristic wireless signal to the receiver; wherein the at least one second transmitter sends a second characteristic wireless signal to the receiver; and, wherein the receiver sends a signal to the controller responsive to a predetermined change in either wireless signal.

5. Apparatus for use on a sail-powered vessel which is movable across the surface of a body of water in a desired direction, for carrying at least one person, and for changing said desired direction of motion of said vessel when a person falls off the vessel, wherein the vessel has a sail or tiller for affecting the desired direction of motion of the vessel, which tiller is held in working position by a connection which secures the tiller to a portion of the vessel, comprising:

means for wirelessly sending a signal to a receiver on the vessel, for carrying by a person on the vessel;

means for holding and releasing said tiller from being secured in said working position; and, means for receiving a wireless signal and acting on said means for holding and releasing;

wherein the means for holding and releasing releases said tiller from said working position responsive to a predetermined change in the strength of said wireless signal at the means for receiving.

6. The apparatus of claim 5 wherein said means for holding and releasing comprises:

a separable mechanical member for holding a sheet which secures the tiller in working position; and, an actuator, for acting on said separable mechanical member, to cause the member at least in part to separate and thereby to release said tiller from said working position, responsive to said predetermined change in signal strength.

7. The apparatus of claim 5 wherein said tiller is secured in working position at least in part by a sheet; and wherein the means for holding and releasing said tiller from said working position comprises (a) a hold and release assembly comprising (i) a separable mechanical member; and, (ii) an actuator, for acting on the mechanical member to cause said member to release said sheet from being secured in said working position; and, (b) a controller for causing an element of the actuator to move in response to a signal from the receiver; wherein, movement of said actuator element acts on said mechanical member to release said sheet from said connected position;

wherein, in response to said signal strength change, the mechanical member releases the connection between the tiller and sheet, to thereby alter the direction of motion of the vessel.

8. The apparatus of claim 5 wherein the means for wirelessly sending said signal is a portable transmitter, for carrying by said person; wherein said means for disengaging comprises (a) an actuator having a movable element; and, (b) a mechanical member attached to actuator, for engaging and disengaging a sheet responsive to motion of said movable element; further comprising: at least one second transmitter, wherein the first transmitter sends a first characteristic wireless signal to the receiver; wherein the at least one second transmitter sends a second characteristic wireless signal to the receiver; and, wherein the receiver sends a signal to the controller responsive to a predetermined change in either wireless signal.

9. The apparatus of claim 5 wherein said sail is held in place by a sheet secured to a portion of the vessel by a caroming type cleat through which the sheet passes; wherein the cleat engages the sheet to prevent linear motion of the sheet within the cleat; and, wherein said means for releasing said sheet comprises: an actuator for urging the sheet, where it passes through the cleat, to move in a direction which is both transverse to the sheet length and transverse to the gripping force of the cleat on the sheet, wherein the force of urging is sufficient to disengage the sheet from the cleat.

10. A method of altering the operation of a sail powered water craft when a person falls overboard, wherein the craft has a sail and a sheet which holds the sail in a connected position relative to a fixed location on the craft, in which connected position the sail propulsively powers the craft, which comprises:

providing a person with a transmitter for sending a wireless signal;

interconnecting a releasable mechanical member with the sheet, to thereby form a combination of sheet and mechanical member which holds the sail in a connected position relative to said fixed location on the craft;

providing the mechanical member with an associated receiver and controller, and wherein said mechanical member releases and alters said connected position between the sail or sheet in response to change in signal received from said transmitter; and, actuating said mechanical member responsive to a predetermined change in wireless signal, to thereby alter said connected position between the sail and the fixed location.

* * * * *